US006491287B1

(12) United States Patent
Savenok

(10) Patent No.: US 6,491,287 B1
(45) Date of Patent: Dec. 10, 2002

(54) METHOD FOR MANUFACTURE OF A BALUSTRADE OF SYNTHETIC MATERIAL AND APPARATUS THEREOF

(76) Inventor: Peter Savenok, 2S 425 Orchard Rd., Wheaton, IL (US) 60187

( * ) Notice: Subject to any disclaimer, the term of this patent is extended or adjusted under 35 U.S.C. 154(b) by 0 days.

(21) Appl. No.: 09/286,796

(22) Filed: Apr. 6, 1999

Related U.S. Application Data

(63) Continuation-in-part of application No. 08/910,636, filed on Aug. 13, 1997.

(51) Int. Cl.[7] ..... E04H 17/14
(52) U.S. Cl. ..... 256/59; 256/19; 256/65
(58) Field of Search ..... 256/65, 19, 59, 256/DIG. 1, 24; 403/229, 325; 52/720.2, 585.1, 706, 707, 710, 711, 715; 16/229

(56) References Cited

U.S. PATENT DOCUMENTS

| | | | | | |
|---|---|---|---|---|---|
| 255,992 | A | * | 4/1882 | Hoopes | 256/19 X |
| 1,904,110 | A | * | 4/1933 | Willmann | 16/229 X |
| 2,334,355 | A | * | 11/1943 | Russell | 52/707 X |
| 3,182,762 | A | * | 5/1965 | Syak et al. | 256/59 |
| 3,332,182 | A | * | 7/1967 | Mark | 256/24 X |
| 3,512,329 | A | * | 5/1970 | Du Plessis | 52/715 X |
| 3,810,339 | A | * | 5/1974 | Russo | 52/707 X |
| 4,368,875 | A | * | 1/1983 | Weiss et al. | 256/65 X |
| 5,283,999 | A | * | 2/1994 | Cooney et al. | 52/706 X |
| 5,372,354 | A | * | 12/1994 | Cacicedo | 256/65 X |
| 5,609,326 | A | * | 3/1997 | Stearns et al. | 256/65 X |
| 5,623,804 | A | * | 4/1997 | Kelly et al. | 52/707 X |
| 5,809,703 | A | * | 9/1998 | Kelly | 52/707 X |
| 5,876,021 | A | * | 3/1999 | Spence et al. | 256/65 X |
| 5,957,437 | A | * | 9/1999 | Savenok | 256/65 |

FOREIGN PATENT DOCUMENTS

| | | | | |
|---|---|---|---|---|
| DE | 1950569 | * | 4/1971 | 256/65 |

* cited by examiner

*Primary Examiner*—Lynne H. Browne
*Assistant Examiner*—David E. Bochna
(74) *Attorney, Agent, or Firm*—Charles F. Meroni, Jr.; Meroni & Meroni, P.C.

(57) ABSTRACT

A balustrade product for connecting to a support structure includes an elongated molded housing to form a synthetic material. An insert member is embedded within the molded housing to form a plurality of holes extending longitudinally through the molded housing. The insert member includes a plurality of supports having openings and a plurality of pipes extended through the openings. The plurality of supports each have a circumferentially spaced plurality of tabs that are sized to extend to an outer portion of the molded housing. The plurality of pipes are positioned in parallel relation to one another and in parallel relation to a longitudinal axis of the balustrade product. Each of the plurality of holes are configured to receive connecting pins for releasable connection with the support structure. The balustrade product is formed by centrifuge molding process with the insert member placed within the mold halves allowing the plurality of tabs to engage the mold halves to position and hold the insert member in place.

17 Claims, 7 Drawing Sheets

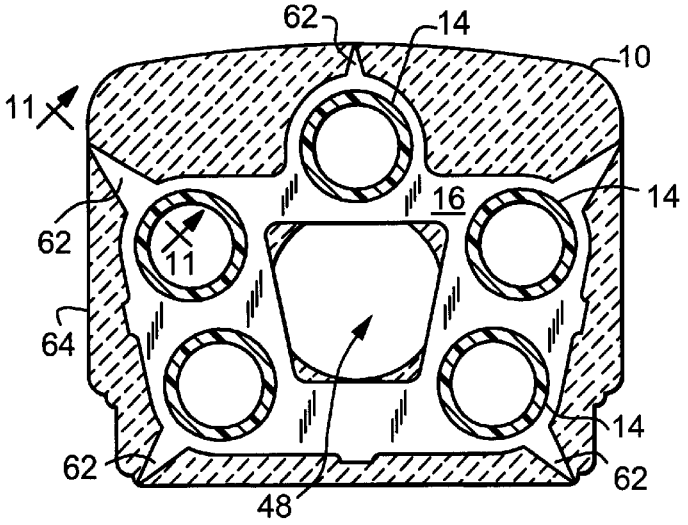
FIG.10
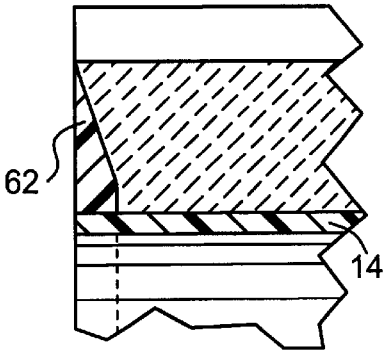
FIG.11
FIG.12
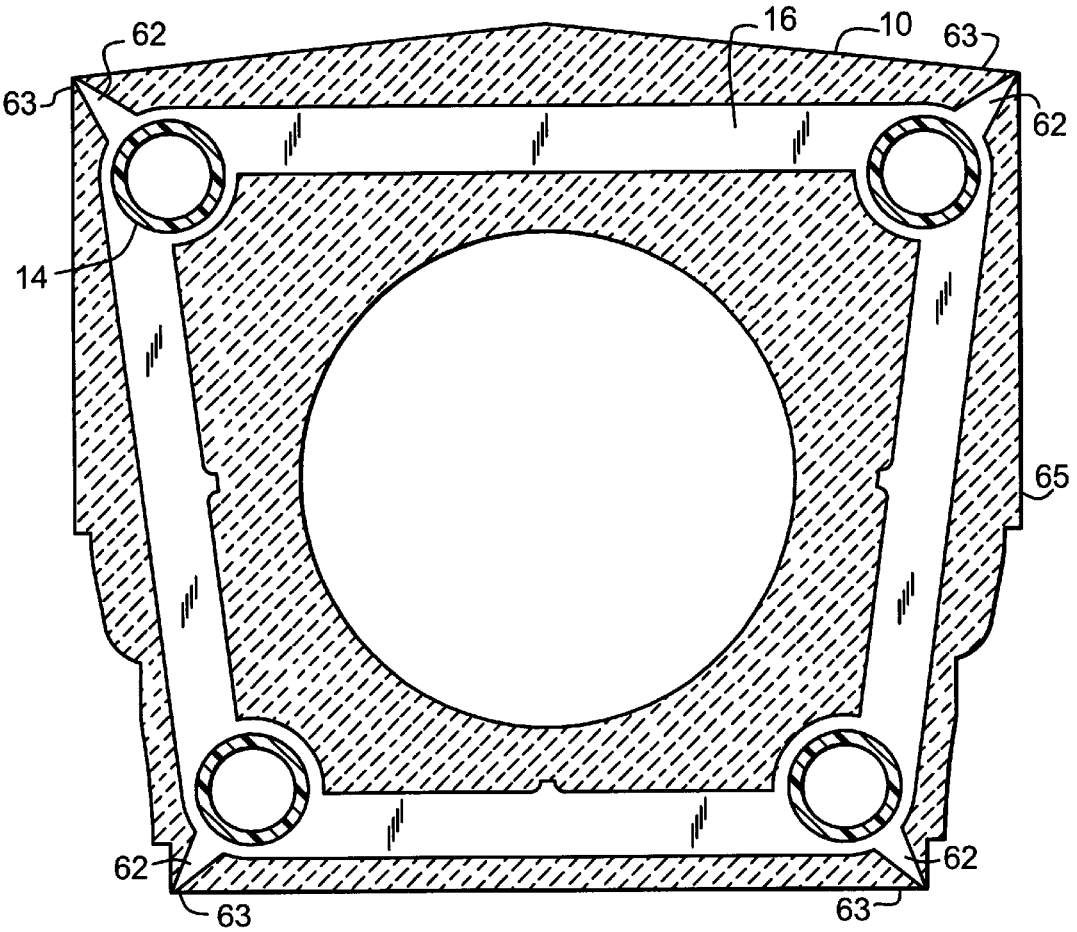

METHOD FOR MANUFACTURE OF A BALUSTRADE OF SYNTHETIC MATERIAL AND APPARATUS THEREOF

DESCRIPTION

This is a continuation-in-part of application Ser. No. 08/910,636, filed Aug. 13, 1997.

TECHNICAL FIELD

The present invention relates generally to a new and improved method of manufacture of a synthetic stone rail, apparatus for performing the method, and a balustrade product. More specifically, the present invention provides a by manufactured synthetic stone rail article in the form of a balustrade product containing holes for receiving a connecting structure.

BACKGROUND ART

In the past, it has been the practice to produce synthetic stone rails with connection holes at opposite ends by using a final drilling step. This method involved a rotatable centrifugal mold having first and second open halves and a cylindrical inner surface adapted to receive a slurry of synthetic stone material, pouring into said first open half of said rotatable mold a predetermined amount of the slurry of synthetic material composition, tightening the mold in a closed state, rotating on a generally horizontal axis the elongated tubular mold causing said substance to acquire the form of a cylindrical lining within said mold in response to the rotation of the mold and resultant centrifugal force. The predetermined amount of fluid material thereby becomes distributed in said cavity in the form of a rail or balustrade product. After opening the first and second halves of the mold and removing the balustrade product, the final step was to produce with a drill a plurality of holes in the balustrade product which are parallel to the balustrade product's center horizontal axis. However, producing a hole in the balustrade product quickly, in a cost-effective manner, and with proper alignment can be difficult and problematic.

As will be described in greater detail hereinafter, the method and apparatus of the present invention solves the aforementioned problems and employs a number of novel features and devices that render it highly advantageous over the prior art.

DISCLOSURE OF INVENTION

Accordingly, it is an object of this invention to provide an improved method and apparatus for forming a balustrade product. It is another object to provide a balustrade having a connection structure that allows for a quick and easy connection of a balustrade with a post or support structure.

As described later in more detail, the problem of producing a hole in the balustrade product quickly, in a cost-effective manner with proper alignment has been solved by my present invention. Further, the previous methods involving drilling in an end of the balustrade product have been obviated.

My present invention fulfills the need for a method and apparatus that produces the hole in the balustrade product quickly, using less steps and equipment, and giving a final product with a properly aligned hole. Specifically, my present invention reduces the time needed to manufacture by producing the necessary hole in the balustrade product during the molding process. More specifically, an insert member inside the mold is used. The insert member is properly aligned within the mold by a plurality of supports. The plurality of supports engage the inside cavity of the mold resulting in properly alignment of a plurality of pipes that engage the plurality of supports. Each pipe is positioned parallel with the mold's center horizontal axis and produce the necessary hole in the balustrade product. The inside cavity of the pipe is sealed off from the slurry composition and leaves a cavity in the balustrade product after solidification. The plurality of holes are through holes that can be used for various functions including receiving fastener means to attach the rail to another member or fixed support.

Another problem with the known method is that additional equipment and steps were added to the method of manufacturing the balustrade product. First, the balustrade product was molded from a slurry composition by rotational molding. Next, the balustrade product was removed from the mold after solidification. The balustrade product would be then fixed in place while drilling equipment was used to produce the necessary hole in the ends of the balustrade product.

My present invention eliminates this drilling step completely. In addition, I found that the holes that resulted from my present invention had proper alignment with the balustrade product's center horizontal axis. This solves a problem that existed with the known method. The known method of drilling the holes resulted in a larger number of improperly aligned holes. My present invention has reduced the number of improperly aligned holes. This is an important feature because if a balustrade product had improperly aligned holes, the entire balustrade product was rendered unusable.

In a preferred embodiment, the insert member used to position a plurality of pipes is made of a material that can easily become an integral part of the balustrade product. In addition, the plurality of pipes are made of a material that can become an integral part of the balustrade product, such as a PVC material that is low in cost. The supports are made of a material that becomes integral with the balustrade product including the same material as the slurry material and an inexpensive polymer material.

My present invention fulfills the need for an aesthetically quality balustrade product. I have designed a plurality of tabs located on each support in such a manner to not be visible upon solidification of the slurry product. Specifically the plurality of tabs are shaped and configured to become an integral part of the balustrade product in such a manner as to not be visible on an outside surface of the balustrade product after removal from the mold.

According to my present invention, I have provided a new and improved method for producing by centrifugal molding a synthetic stone rail article of manufacture in the form a balustrade product containing holes, including the steps of: providing a rotatable centrifugal mold having first and second open halves and a cylindrical inner surface adapted to receive a slurry of synthetic stone material, an apparatus in the form of an insert member, each insert member having a plurality of supports and a plurality of pipes, each support having a plurality of tabs, the plurality of tabs are shaped and configured to position each support inside the mold, each tab engages the mold at an inside surface, each pipe passes through the plurality of supports at a plurality of holes in each support, each pipe has an outside surface, each hole has an inside surface, the outside surface engages the inside surface, the plurality of supports positioning each pipe inside the mold, the apparatus in the form of an insert member being set into the mold, which is in an open state, so that the plurality of supports are arranged perpendicular to the mold's center horizontal axis and the plurality of pipes are parallel with the mold's center horizontal axis, pouring into said first open half of said rotatable mold a predetermined amount of the slurry of synthetic material composition, tightening the mold in a closed state and thereby pressing the insert member against inner surfaces of the mold and also thereby positioning the pipes, rotating on a generally horizontal axis, the elongated tubular mold causing said substance to acquire the form of a cylindrical lining within said mold in response to the rotation of the mold and resultant centrifugal force, the predetermined amount of fluid material becomes distributed in said cavity in the form of a rail with the insert member integral with the balustrade product, solidifying said fluid material in said rotating mold such as to form a blank hollow cylinder within the balustrade product, and opening the first half and the second half of the mold and removing the balustrade product.

The method for manufacture of a balustrade of synthetic material composition in a preferred embodiment further includes the mold being made from an extruded aluminum. The method for manufacture of a balustrade of synthetic material composition further includes the plurality of supports being made from the slurry material and the plurality of pipes being made from PVC material.

Other objects, features and advantages of the invention will become more readily apparent upon reference to the following description when taken in conjunction with the accompanying drawings, which drawings illustrate several embodiments of the invention.

BRIEF DESCRIPTION OF DRAWINGS

In the drawings:

FIG. 10 is an end view of a cross section of a preferred embodiment of the balustrade product showing important features of my invention including the insert member integral with the slurry composition;

FIG. 11 is a section view along line 11—11 of FIG. 10;

FIG. 12 is a section view of another embodiment of the balustrade product showing the insert member integral with the slurry composition;

BEST MODE FOR CARRYING OUT THE INVENTION

Figure 1:
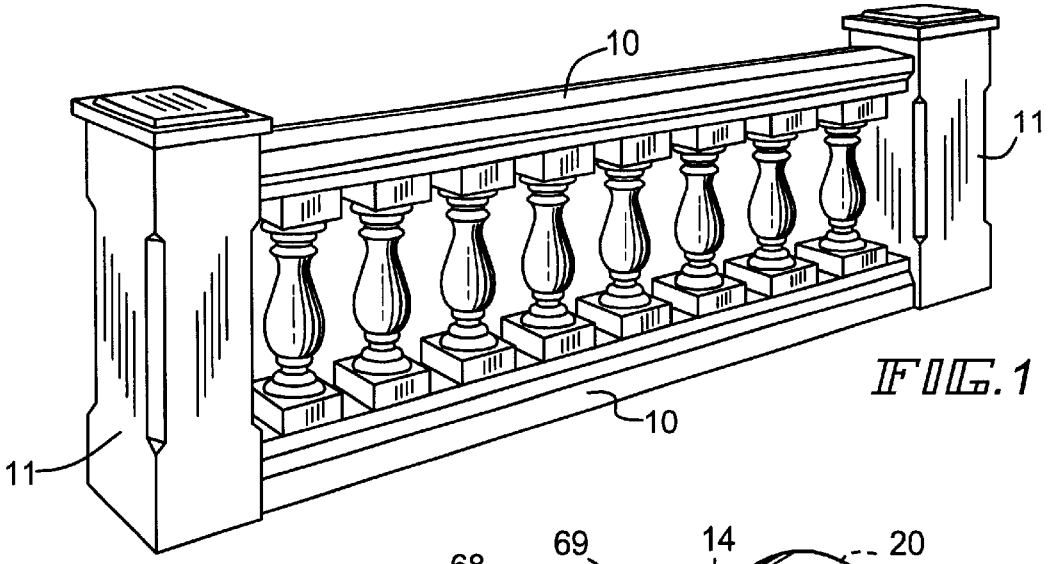
FIG. 1 is a perspective view of the balustrade product constructed in accordance with the principals of the present invention.

Referring now to the drawings, a method for manufacture of a balustrade of synthetic stone and several embodiments of apparatus of the invention will be described below. Further, the disclosure and drawings of parent U.S. Pat. application Ser. No. 08/910,636, filed Aug. 13, 1997 are incorporated herein by reference.

Figure 2:
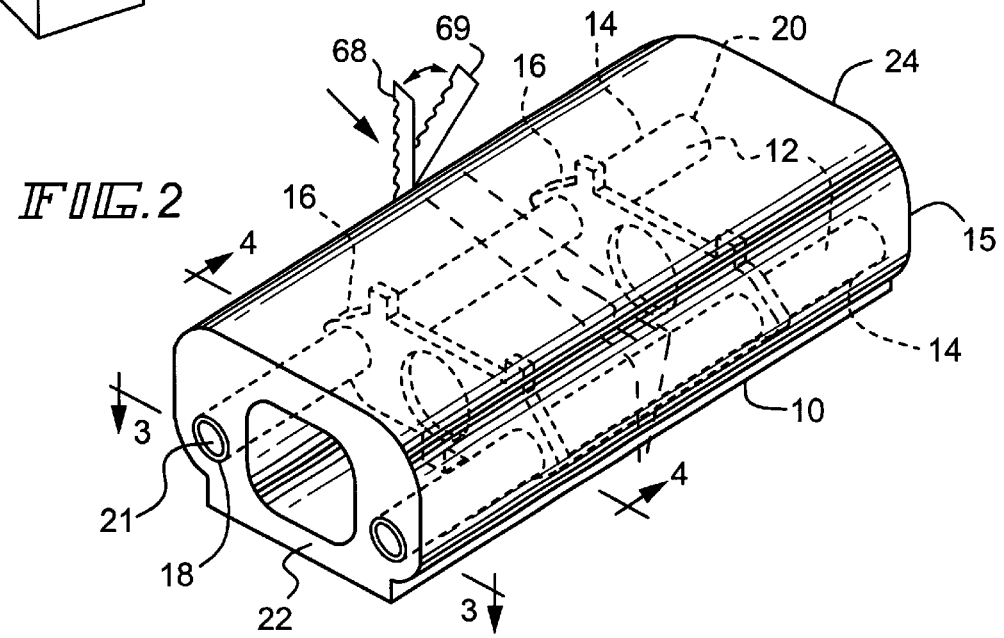
FIG. 2 is a perspective view of a section of one embodiment of the balustrade product showing important features of my invention.
Figure 3:
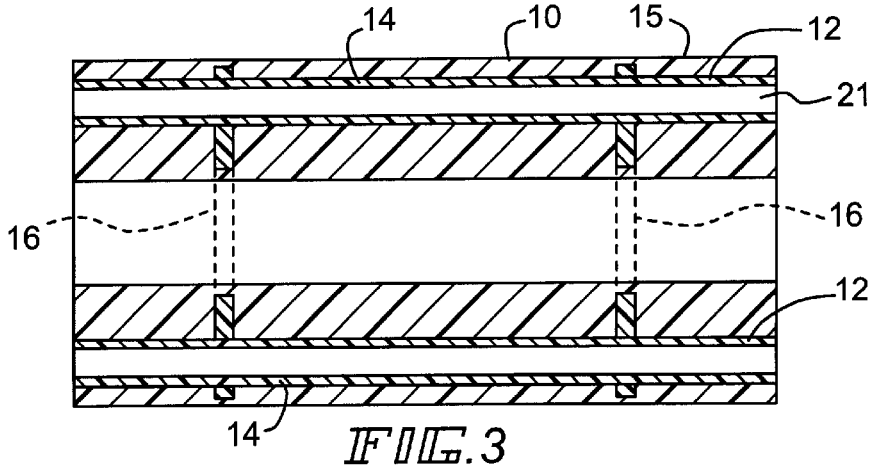
FIG. 3 is a section view taken along line 3—3 of FIG. 2.

FIG. 1 shows a perspective view of the balustrade product or rail 10 in its final environment where the balustrade 10 is connected at opposite ends to support structures or posts 11. FIG. 2 shows a perspective view of a section of the balustrade product 10. FIGS. 2 and 3 show the insert member 12 including a pipe 14 and a support 16. The pipe 14 runs parallel to the center or longitudinal axis of the balustrade product 10. The support 16 is arranged perpendicular to the center axis of the balustrade product 10.

Pipe 14 has a first end 18 and a second end 20. The first end 18 and second end 20 provide end holes 21 in the balustrade product 10 at a first end 22 and second end 24 of the balustrade product 10. The insert member 12 is embedded in an elongated molded housing 15 formed of a synthetic material, which is described later in more detail. Preferably, the insert member 12 is comprised of a plurality of supports 16 having openings and a plurality of pipes 14 extended through the openings of the plurality of supports 16. Each of the plurality of supports 16 are spaced apart longitudinally relative to one another along the length of the plurality of pipes 14, as illustrated in FIGS. 2 and 3.

Figure 5:
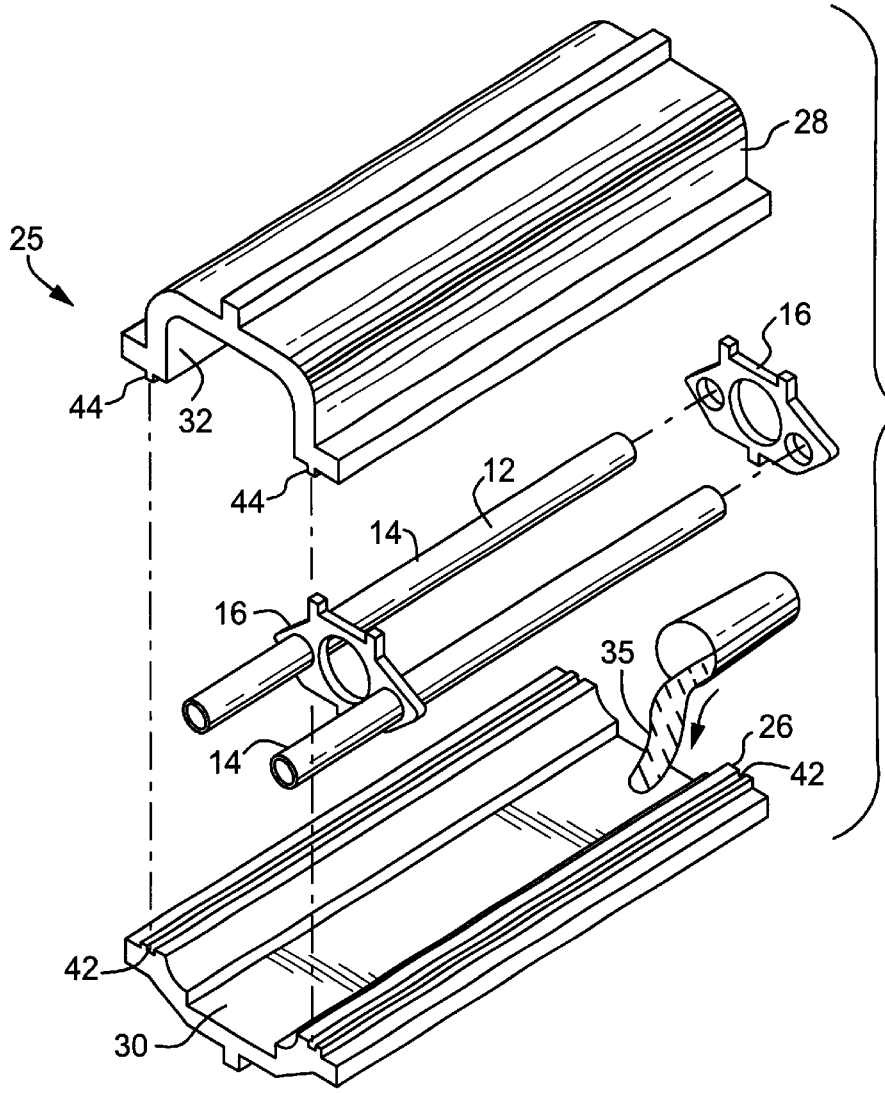
FIG. 5 is an exploded perspective view of a mold assembly for forming the balustrade product of FIG. 2.

Referring to FIG. 5, a perspective view of a mold 25 is shown containing first and second mold halves 26, 28. The first and second mold halves 26, 28 have inside surfaces 30, 32. The inside surfaces 30, 32 are shaped and configured to produce the balustrade product 10. The insert member 12 is inserted in the mold 25 during the manufacturing process so that it becomes embedded and formed integral with the molded housing 15.

Figure 4:
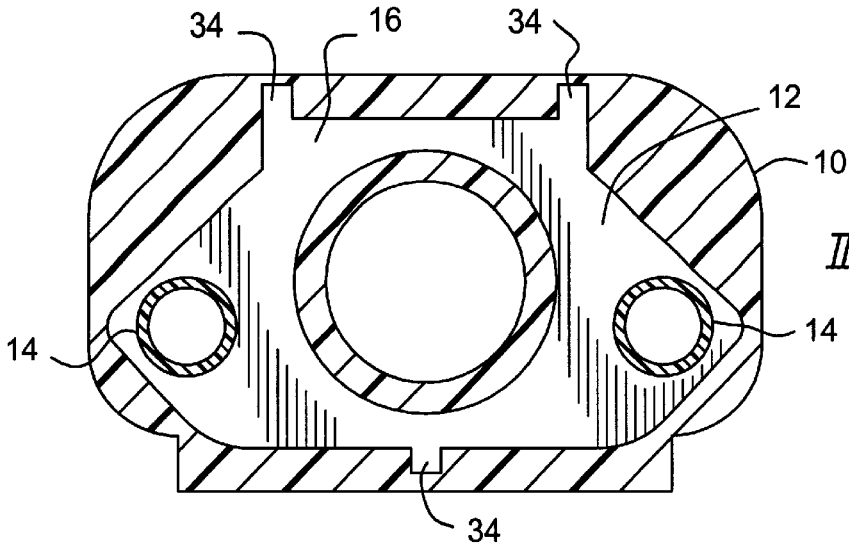
FIG. 4 is a section view taken along line 4—4 of FIG. 2.
Figure 6:
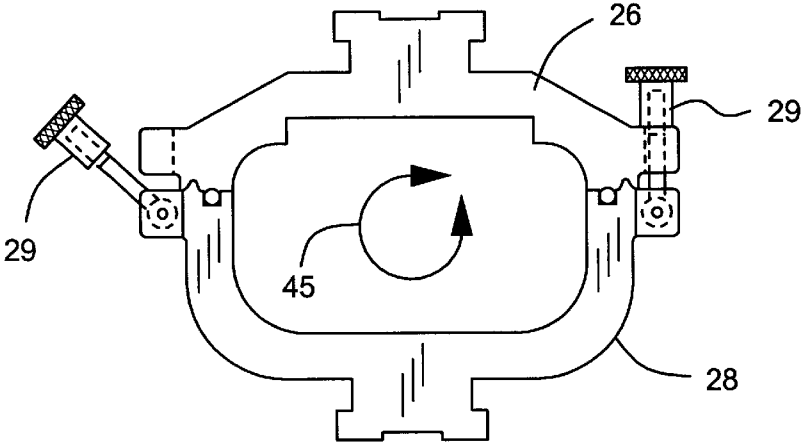
FIG. 6 is an end view of the mold assembly of FIG. 6 showing clamps to secure mold halves together.

FIG. 4 shows the support 16 embedded in the balustrade product 10. The support 16 has a plurality of tabs 34. The tabs 34 are shaped and configured to position the support 16 inside the first and second mold halves 26, 28. The mold 25 receives a predetermined amount of a slurry material composition 35. The first mold half 26 has a lip 42 that runs the entire length of the first mold half 26. The second mold half 28 has a lip 44 that runs the entire length of the second mold half 28. The predetermined amount of slurry composition 35 is placed into one of the mold halves. The first and second mold halves 26, 28 are then placed in a closed state. FIG. 6 shows clamps 29 of conventional designed used to secure the mold halves 26, 28 together. When the mold 25 is in a closed state the lip 42 engages the lip 44 sealing the mold 25 keeping the slurry 35 inside the mold 25. The mold is then rotated in a centrifuge process indicted by arrow 45 of FIG. 6.

Figure 7:
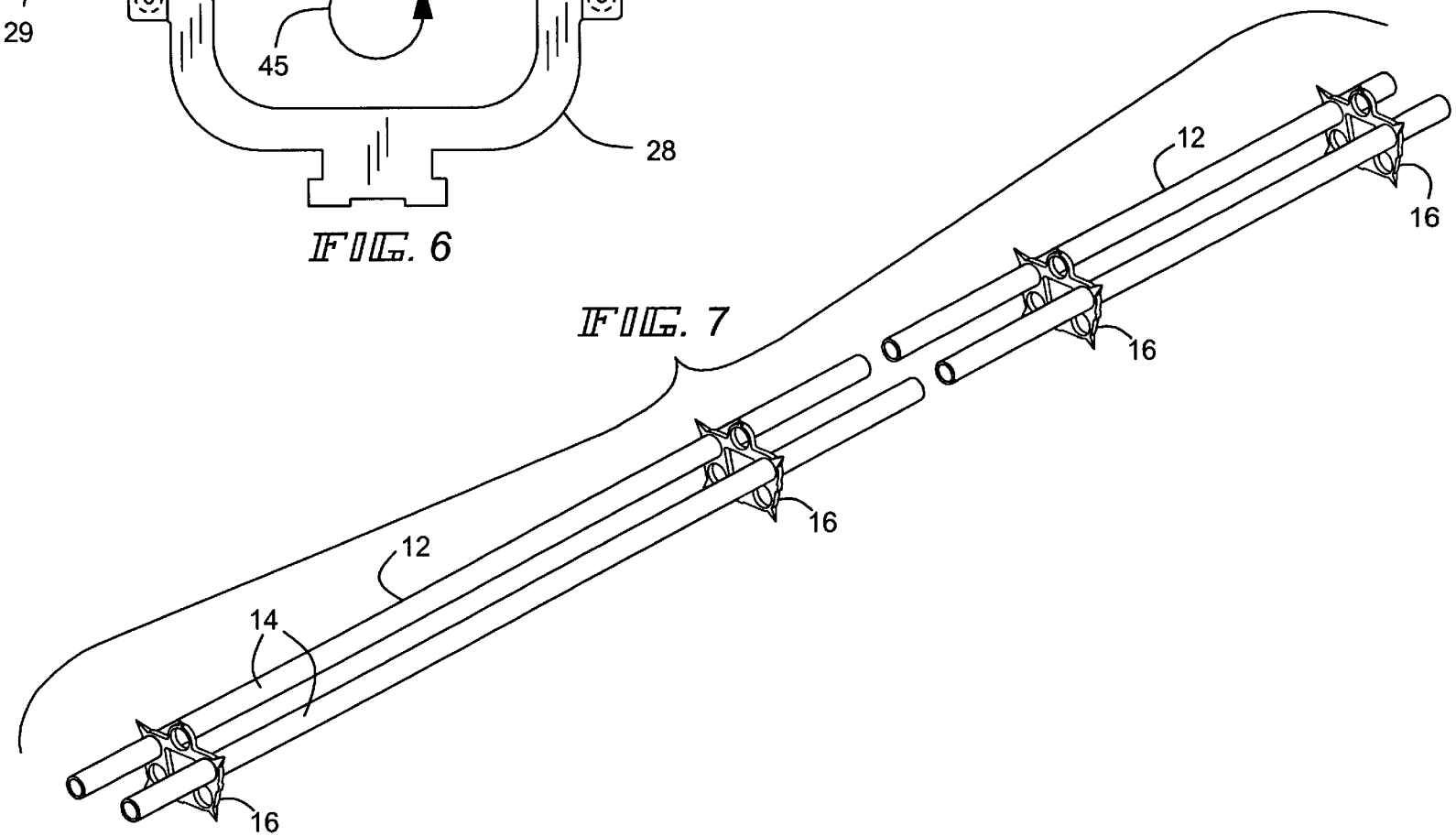
FIG. 7 is a perspective view of an insert member of a preferred embodiment.
Figures 8, 9:
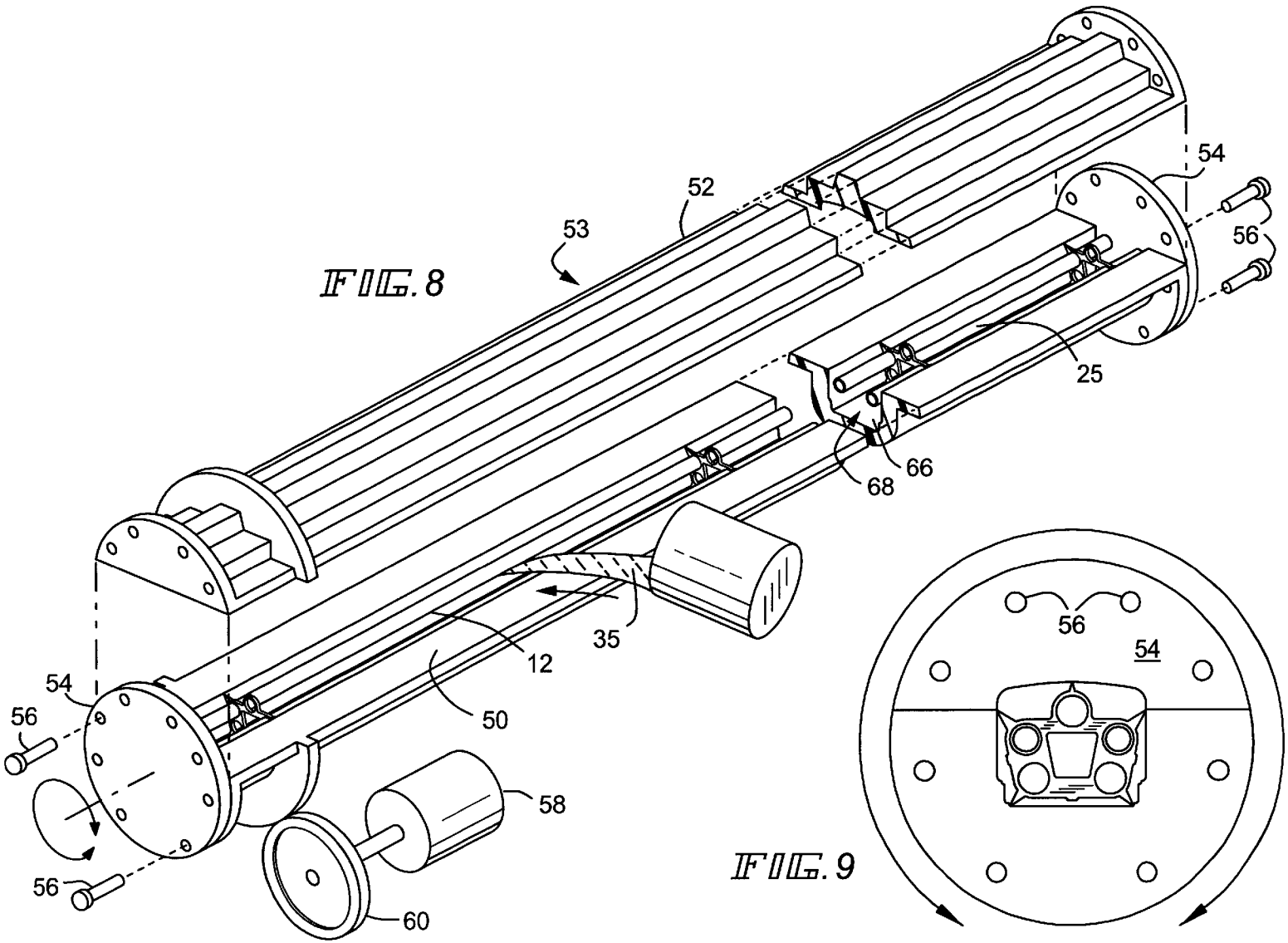
FIG. 8 is an exploded diagrammatic perspective view of the mold assembly and method for manufacture of a balustrade product.
FIG. 9 is an end view of the mold assembly of FIG. 8.

Referring to FIGS. 7 and 11, a preferred embodiment of the method and apparatus of the present invention is shown. In FIG. 7, the insert member 12 is shown in its elongated state. The insert member 12 is inserted into a first mold half 50. The slurry is poured into the first mold half 50 and the second mold half 52 is connected to the first mold half 50 using end plates 54 and bolts 56 as shown in FIGS. 8 and 9. A motor 58 is connected to a wheel or gear 60 to rotate the mold 53, as described later in more detail.

FIGS. 10 and 11 show section views of the balustrade 10 of the preferred embodiment. The support 16 includes a circumferentially spaced plurality of tabs 62 at an outer diameter of the support 16. The plurality of tabs 62 are radially sized to extend to an outer portion of the molded housing as best illustrated in FIG. 11. As similarly described in the embodiment of FIG. 4, the tabs 62 are arranged and configured on the support 16 in such a manner as to position the pipe 14 parallel with the mold's center axis. Further, the ends of the tabs 62 are shaped and configured to become an integral part of the balustrade product 10 upon the solidification of the slurry composition. In addition, the tabs 62 are designed in such a manner so they do not appear on the outside surface 64 of the balustrade product 10. In a preferred embodiment, the ends of tabs 62 are caused to bend or flex as the mold halves 50, 52 are connected together allowing for a tight and engaging fit of the support 16 therewithin. If any portion of the ends of tabs 62 are exposed after the molding process, they may be simply ground off. Referring to FIG. 12, an alternative embodiment of a balustrade product 10 is shown having a support 16 holding four pipes 14 at corners 63 of the mold housing 65.

The mold 53 (FIG. 8), in a closed state, with the predetermined slurry composition sealed inside is rotated about the mold's center axis. The rotating is on a generally horizontal axis, the elongated tubular mold 53 causes the slurry composition to acquire the form of a cylindrical lining within the mold 53 in response to the rotation of the mold 53 and resultant centrifugal force. The predetermined amount of slurry composition becomes distributed in the mold 25 cavity in the form of a balustrade product 10 with the insert member 12 integral with the balustrade product 10 and a blank hollow cylinder 48 within.

In accordance with a method illustrated in FIGS. 7–10 for producing a synthetic stone rail article by centrifugal molding in the form a balustrade product 10 containing holes adapted for receiving a connection assembly, the method includes the step of providing a rotatable centrifugal mold 53 having an upper half 50 and a lower half 52 together defining a inner cylindrical surface 66 defining a cavity 68 (FIG. 8) shaped to form the balustrade product 10. The cavity 68 is adapted to receive a slurry 35 of synthetic stone material composition.

The process first requires assembling an insert member 12 (FIG. 7) by extending a plurality of pipes 14 through a plurality of openings in a plurality of supports 16 and spacing the supports at longitudinally spaced intervals relative to one another along the length of the plurality of pipes 14.

Next, the insert member 12 is set into the lower half 50 (FIG. 8) while the mold 53 is in an open state with the plurality of supports 16 being arranged perpendicular to a longitudinal axis of the mold 53 and the plurality of pipes 16 being arranged parallel with the longitudinal axis of the mold. The plurality of tabs 62 are engaging the inner cylindrical surface 66 of the mold 53 consequently positioning the pipes 14 in parallel relation to one another and in parallel relation to a center axis of the mold 53.

A predetermined amount of the slurry 35 of synthetic material composition is poured into the lower half 50 of the mold 53 and mold is closed. Using end plates 54 and bolts 56 the mold halves are tightened in a closed state thereby pressing the tabs 62 on the insert member 12 against the cylindrical inner surface 66 of the mold 53 and also thereby positioning the pipes 14 centrally to the mold halves 50, 52.

The elongated tubular mold 53 is rotated on its generally longitudinal axis causing said slurry 35 of synthetic material composition to acquire the form of the inner cylindrical surface within the mold 53, as previously described, causing the predetermined amount of slurry of synthetic material composition to become distributed in the cavity and coacting with the cylindrical inner surface to form a balustrade product 10. Solidifying of the slurry 35 in the mold 53 forms a blank hollow cylinder within the balustrade product 10.

After separating the upper and the lower halves 50, 52 of the mold 53 and removing the balustrade product, the outer surface of the balustrade product 10 can be ground with a conventional grinding process to remove any surface imperfections resulting from the use of the mold 53.

Preferably, the mold 53 is made of a an extruded aluminum, the plurality of supports 16 are made from the slurry material composition and the plurality of pipes 14 are made from a PVC material.

Referring back to FIG. 2, the balustrade product 10 can be formed at a molded length with a desired length of being cut from the molded length. It should be understood that the balustrade product 10 of FIG. 2 has been shown with a reduced length for illustrative purposes. In some applications, the desired end surface of the balustrade product 10 is perpendicular to the longitudinal axis of the balustrade product 10. In other applications, an end surface of the balustrade product is cut to desired angle relative to the longitudinal axis of the balustrade product. For illustrative purposes, cutting member 68 is shown diagrammatically to cut the balustrade product perpendicular to the longitudinal axis whereas cutting member 69 is shown at an angled relation to provide an angle cut as shown in the balustrade product 10 of FIG. 14.

Figure 13:
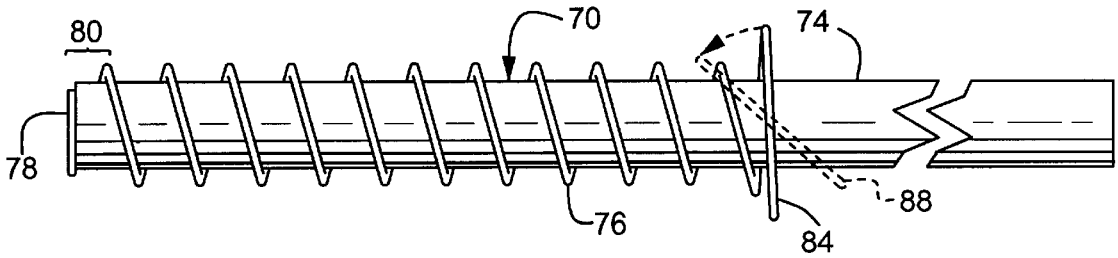
FIG. 13 is a side view of a connecting pin assembly.
Figure 14:
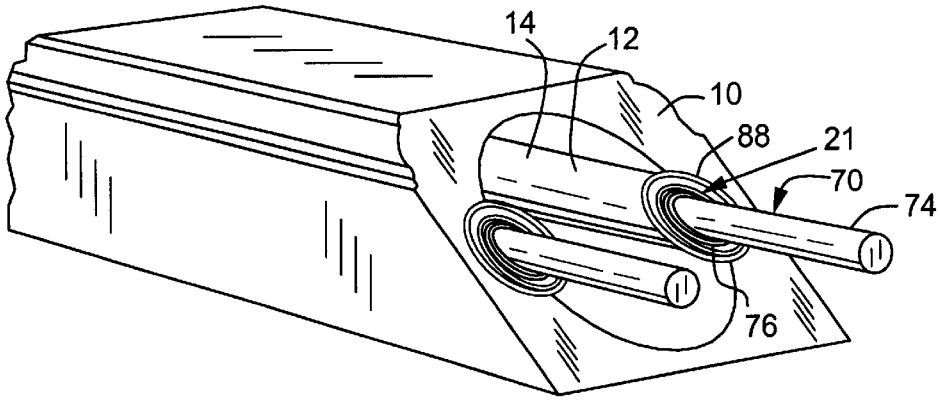
FIG. 14 is a perspective view an end of a balustrade product having the pin assemblies connected therewithin.
Figure 15:
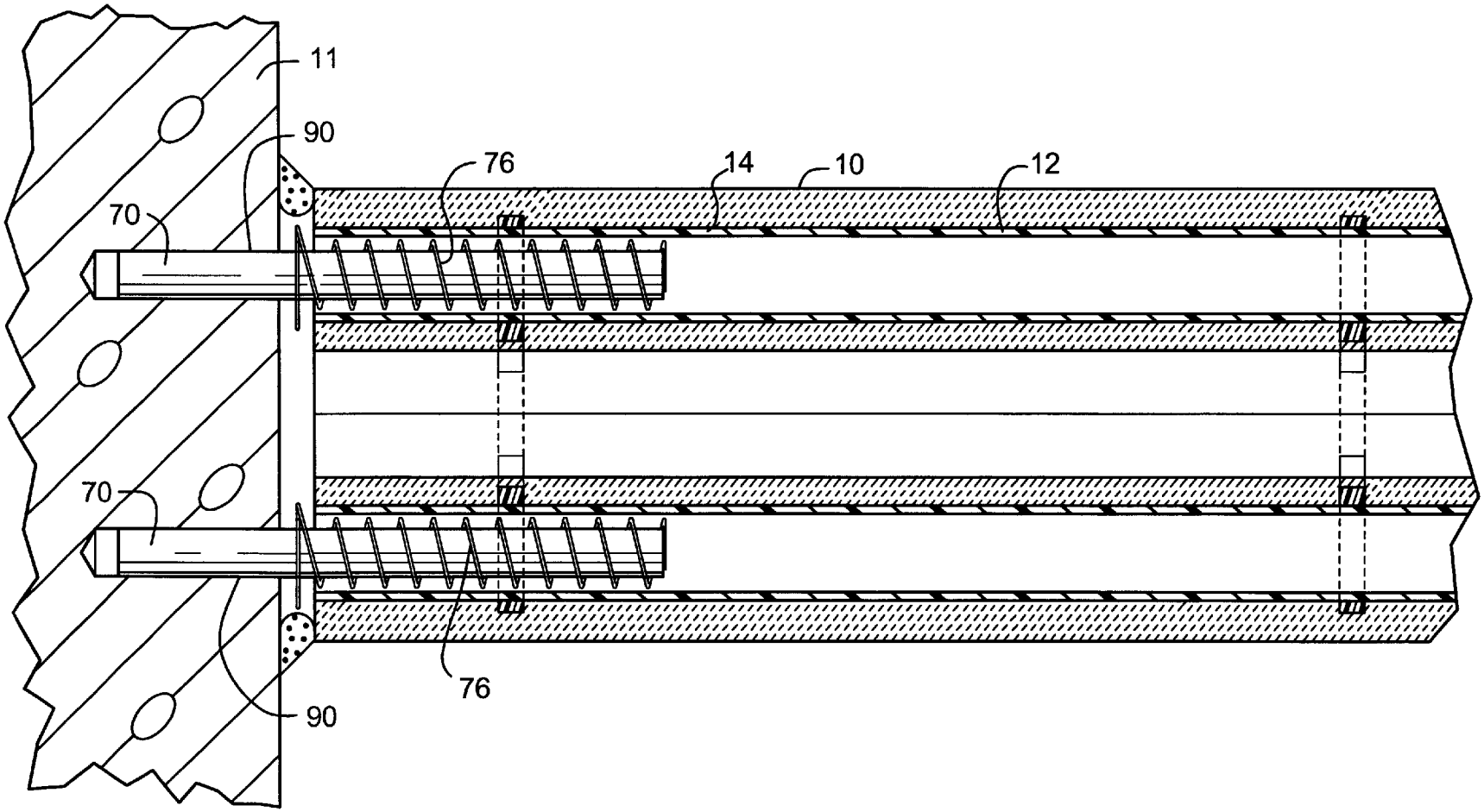
FIG. 15 is a section view of the balustrade product connected to a support structure.

Referring to FIGS. 13–15, the plurality of holes in the balustrade product 10 are adapted to receive a balustrade connector or connecting pin 70 that is constructed to be recessed into the hole at an end of a balustrade product or rail 10 to enable the connection of the balustrade product 10 to a complementary aligned hole in the support structure 11. The connecting pin 70 is comprised of a connecting rod 74 and a spiral spring 76. The spiral spring 76 has an uncompressed length less than the length of the rod 74. The spiral spring 76 has a diameter larger than the rod and is positioned about the rod. The spiral spring 76 has a stop 78 secured at a first end 80 to prohibit the rod 74 from passing past the first end of the spiral spring, but allows the rod to freely slide within the diameter of the spiral spring. The diameter of the spiral spring 76 is designed to be less than a diameter of the hole 21 at the end of a rail 10 in order to allow the spiral spring to freely move within the prealigned hole 21. The spiral spring 76 has a flange 84 at a second end. The flange 84 has a diameter greater than the diameter of the prealigned hole 21 positioned at the end of the rail 10.

When the rod 74 is pushed into the prealigned hole 21 after the connector 70 has been placed in the prealigned hole 21, the flange 84 prohibits an upper portion of the spiral spring 76 from being pushed into the prealigned hole and the stop 78 on the spiral spring acts to stretch the spiral spring within the prealigned hole. The rail 10 can then be aligned with a complementary aligned hole 90 in a support structure 11 (FIG. 15) and a spring load from the stretched spiral spring acts to forces a portion of the rod 74 to engage with the complimentary aligned hole 90. This allows for a neatly connected rail of a balustrade 10 to a support structure 11. The stop 78 holds on to the first end 80 of the rod 74 and keeps the rod from disengaging from within the spiral spring and further keeps the rod from leaving the prealigned hole 90.

The stop 78 at the first end 80 of the spiral spring 76 is an inwardly coiled wire extending from the first end of the spiral spring. The stop 78 further pinches the rod to securely fasten the spiral spring to the rod. The flange 84 at the second end of the spiral spring 76 is an annular outwardly coiled wire extending from the second end of the spiral spring. Various different methods can be used to create a stop or a flange on the spiral spring, including, but not limited to securing a plate to the spring to act as a stop or securing a washer to the other end of the spring to act as a flange.

This connecting pin 70 can also be used on a balustrade product 10 (FIG. 14) having an angled end surface. In order to use the connecting pin 70 with an angled surface, the flange 84 on the spiral spring 76 is angled 88 to enable the connecting pin to be used on an angled or mitered joint. This connecting pin 70 also allows one to remove the rail from the supporting structure by using a thin tool to move the pin laterally.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A balustrade structure combination comprising:

a balustrade product having a molded housing and an insert member secured in the molded housing to form a plurality of holes extending longitudinally through the molded housing, the insert member comprising a plurality of supports having openings and a plurality of hollow pipes extended through the openings of the plurality of supports, each of the plurality of supports being spaced apart longitudinally relative to one another along the length of the plurality of hollow pipes, the plurality of supports having a circumferentially spaced plurality of tabs at an outer diameter of each support, the plurality of tabs radially sized to extend to an outer portion of the molded housing; the plurality of hollow pipes being positioned in parallel relation to one another and in parallel relation to a longitudinal axis of the balustrade product;

a support structure; and connecting means for releasably connecting the balustrade product to the support structure.

2. The balustrade structure combination of claim 1, wherein the support structure has a receiving hole and the connecting means includes a connecting rod having a smooth surface adapted to be recessed into one of said plurality of holes of the balustrade product with one end of the connecting rod being releasably engageable into the receiving hole of the support structure.

3. The balustrade structure combination of claim 2, wherein the connecting rod has a spring operatively connected thereto, said spring on the connecting rod acting to keep a predetermined portion of the connecting rod protruding from the molded housing, whereby when said connecting rod is pushed into said molded housing the spring acts to push the predetermined portion of the connecting rod from the molded housing allowing the one end of the connecting rod to releasably engage the receiving hole of the support structure when aligned therewith.

4. The balustrade structure combination of claim 2, wherein each of the plurality of holes at opposite ends of the balustrade product has a connecting rod and spring recessed therein.

5. The balustrade structure combination of claim 1, wherein the balustrade product has a hollow cylinder along the entirety of its length formed therewithin.

6. A balustrade product comprising:

an elongated molded housing formed of a synthetic material; and an insert member embedded within the molded housing to form a plurality of holes extending longitudinally through the molded housing, the insert member comprising a plurality of supports having openings and a plurality of hollow pipes extended through the openings of the plurality of supports, each of the plurality of supports being spaced apart longitudinally relative to one another along the length of the plurality of hollow pipes, the plurality of supports having a circumferentially spaced plurality of tabs, the plurality of tabs radially sized to extend to an outer portion of the molded housing and not protruding therethrough, the plurality of hollow pipes being positioned in parallel relation to one another and in parallel relation to a longitudinal axis of the balustrade product.

7. The balustrade product of claim 6, further comprising a connecting rod adapted to be recessed into one of said plurality of holes of the balustrade product, the connecting rod having a spring operatively connected thereto, said spring on the connecting rod acting to keep a predetermined portion of the connecting rod protruding from the molded housing, whereby when said connecting rod is pushed into said molded housing the spring acts to push the predetermined portion of the connecting rod from the molded housing.

8. The balustrade product of claim 7, wherein each of the plurality of holes at opposite ends of the balustrade product has a connecting rod and spring recessed therein.

9. The balustrade product of claim 6, wherein the molded housing has hollow cylinder along the entirety of its length formed therewithin.

10. The balustrade product of claim 6, wherein the balustrade product is formed at a molded length with a desired length of balustrade product being cut from the molded length.

11. The balustrade product of claim 10, wherein an end surface of the balustrade product is perpendicular to the longitudinal axis of the balustrade product.

12. The balustrade product of claim 10, wherein an end surface of the balustrade product is cut to a desired angle relative to the longitudinal axis of the balustrade product.

13. A balustrade connecting pin used in connecting a rail of a balustrade to a support structure, the connecting pin being constructed to be recessed into a prealigned hole at an end of the rail to enable the connection of the rail to a complementary aligned hole in the support structure, the connecting pin comprising:

a rod and a spiral spring, said spiral spring having an uncompressed length less than the length of the rod, said spiral spring having a diameter larger than a diameter of the rod and being positioned about the rod, said spiral spring having a stop tightly secured at a bottom edge of a first end to prohibit the rod from passing past the first end of the spiral spring but allowing the rod to freely slide within the diameter of the spiral spring, the diameter of the spiral spring being less than a diameter of a prealigned hole at the end of a rail to allow the spiral spring to freely move within the prealigned hole, said spiral spring having a flange at a second end, said flange having a diameter greater than the diameter of the prealigned hole at the end of the rail, whereby when said rod is pushed into the prealigned hole the flange prohibits an upper portion of the spiral spring from being pushed into the prealigned hole and the stop on the spiral spring acts to stretch the spiral spring within the prealigned hole, the rail can then be aligned with a complementary aligned hole in a support structure and a spring load from the stretched spiral spring acts to force a portion of the rod to engage with the complimentary aligned hole, thereby connecting the rail of the balustrade to the support structure.

14. A balustrade structure combination comprising:

a balustrade product having a molded housing and an insert member secured in the molded housing to form a plurality of holes extending through the molded housing, the insert member comprising a plurality of supports having openings and a plurality of pipes extended through the openings of the plurality of supports, each of the plurality of supports being spaced apart longitudinally relative to one another along the length of the plurality of pipes, the plurality of supports having a circumferentially spaced plurality of tabs at an outer diameter of each support, the plurality of tabs radially sized to extend to an outer portion of the molded housing; the plurality of pipes being positioned in parallel relation to one another and in parallel relation to a longitudinal axis of the balustrade product;

a support structure, wherein the support structure has a receiving hole; and connecting means for releasably connecting the balustrade product to the support structure, wherein the connecting means includes a connecting rod adapted to be recessed into one of said plurality of holes of the balustrade product with one end of the connecting rod being releasably engageable into the receiving hole of the support structure, wherein the connecting rod has a spring operatively connected thereto, said spring on the connecting rod acting to keep a predetermined portion of the connecting rod protruding from the molded housing, whereby when said connecting rod is pushed into said molded housing the spring acts to push the predetermined portion of the connecting rod from the molded housing allowing the one end of the connecting rod to releasably engage the receiving hole of the support structure when aligned therewith.

15. A balustrade structure combination comprising:

a balustrade product having a molded housing and an insert member secured in the molded housing to form a plurality of holes extending through the molded housing, the insert member comprising a plurality of supports having openings and a plurality of pipes extended through the openings of the plurality of supports, each of the plurality of supports being spaced apart longitudinally relative to one another along the length of the plurality of pipes, the plurality of supports having a circumferentially spaced plurality of tabs at an outer diameter of each support, the plurality of tabs radially sized to extend to an outer portion of the molded housing; the plurality of pipes being positioned in parallel relation to one another and in parallel relation to a longitudinal axis of the balustrade product;

a support structure, wherein the support structure has a receiving hole; and connecting means for releasably connecting the balustrade product to the support structure, wherein the connecting means includes a connecting rod and spring adapted to be recessed into one of said plurality of holes of the balustrade product with one end of the connecting rod being releasably engageable into the receiving hole of the support structure, and wherein each of the plurality of holes at opposite ends of the balustrade product has a connecting rod and spring recessed therein.

16. A balustrade product comprising:

an elongated molded housing formed of a synthetic material;

an insert member embedded within the molded housing to form a plurality of holes extending longitudinally through the molded housing, the insert member comprising a plurality of supports having openings and a plurality of pipes extended through the openings of the plurality of supports, each of the plurality of supports being spaced apart longitudinally relative to one another along the length of the plurality of pipes, the plurality of supports having a circumferentially spaced plurality of tabs, the plurality of tabs radially sized to extend to an outer portion of the molded housing, the plurality of pipes being positioned in parallel relation to one another and in parallel relation to a longitudinal axis of the balustrade product; and a connecting rod adapted to be recessed into one of said plurality of holes of the balustrade product, the connecting rod having a spring operatively connected thereto, said spring on the connecting rod acting to keep a predetermined portion of the connecting rod protruding from the molded housing, whereby when said connecting rod is pushed into said molded housing the spring acts to push the predetermined portion of the connecting rod from the molded housing.

17. A balustrade product comprising:

an elongated molded housing formed of a synthetic material;

an insert member embedded within the molded housing to form a plurality of holes extending longitudinally through the molded housing, the insert member comprising a plurality of supports having openings and a plurality of pipes extended through the openings of the plurality of supports, each of the plurality of supports being spaced apart longitudinally relative to one another along the length of the plurality of pipes, the plurality of supports having a circumferentially spaced plurality of tabs, the plurality of tabs radially sized to extend to an outer portion of the molded housing, the plurality of pipes being positioned in parallel relation to one another and in parallel relation to a longitudinal axis of the balustrade product; and a connecting rod adapted to be recessed into one of said plurality of holes of the balustrade product, the connecting rod having a spring operatively connected thereto, said spring on the connecting rod acting to keep a predetermined portion of the connecting rod protruding from the molded housing, whereby when said connecting rod is pushed into said molded housing the spring acts to push the predetermined portion of the connecting rod from the molded housing, and wherein each of the plurality of holes at opposite ends of the balustrade product has a connecting rod and spring recessed therein.

* * * * *

Disclaimer 6,491,287—Peter Savenok, 2S 425 Orchard Rd., Wheaton., IL (US) 60187. METHOD FOR MANUFACTURE OF A BALUSTRADE OF SYNTHETIC MATERIAL AND APPARATUS THEREOF. Patent dated December 10, 2002. Disclaimer filed January 28, 2011 by the inventor, Hereby disclaim the patent and its claims in their entirety.

(*Official Gazette* March 8, 2011)